US005332117A

United States Patent [19]

Yadegar

[11] Patent Number: 5,332,117

[45] Date of Patent: Jul. 26, 1994

[54] ADJUSTABLE TISSUE BOX

[76] Inventor: Iraj Yadegar, P.O. Box 1635, Studio City, Calif. 91604

[21] Appl. No.: 25,972

[22] Filed: Mar. 3, 1993

[51] Int. Cl.[5] ..... B65H 1/04

[52] U.S. Cl. ..... 221/33; 221/52; 221/54; 221/56; 221/305

[58] Field of Search ..... 221/33, 52, 53, 54, 221/56, 57, 58, 61, 62, 305

[56] References Cited

U.S. PATENT DOCUMENTS

| | | | |
|---|---|---|---|
| 722,436 | 3/1903 | Suppan | 105/463.1 X |
| 751,798 | 2/1904 | Lieb | 105/238.1 |
| 986,484 | 3/1911 | Miller | 104/20 X |
| 1,229,875 | 6/1917 | Briggs | 414/334 |
| 1,392,523 | 10/1921 | Pereire et al. | 105/176 X |
| 1,550,239 | 8/1925 | Billings et al. | 414/339 |
| 1,634,490 | 7/1927 | Collis | 105/1.4 |
| 2,234,522 | 3/1941 | Fleet et al. | 105/463.1 X |
| 2,246,716 | 5/1939 | Bottrill | 105/463.1 X |
| 2,928,605 | 3/1960 | Kirst | 105/463.1 X |
| 3,202,316 | 8/1965 | Silver | 221/52 X |
| 3,221,928 | 12/1965 | Horn | 221/56 X |
| 3,425,595 | 2/1969 | Shapira | 221/52 |
| 5,147,631 | 3/1993 | Mishima | 221/52 |
| 5,201,152 | 4/1993 | Heffner | 238/13 X |

FOREIGN PATENT DOCUMENTS

| | | | |
|---|---|---|---|
| 629496 | 5/1936 | Fed. Rep. of Germany | 105/26.05 |
| 1455177 | 3/1969 | Fed. Rep. of Germany | 105/116 |
| 2209457 | 9/1973 | Fed. Rep. of Germany . | |
| 402248 | 10/1909 | France . | |
| 472036 | 11/1914 | France | 221/52 X |
| 16326 | 3/1885 | Italy . | |
| 1555404 | 4/1990 | U.S.S.R. . | |
| 2136 | of 1889 | United Kingdom . | |
| 377780 | 8/1932 | United Kingdom . | |

*Primary Examiner*—D. Glenn Dayoan
*Assistant Examiner*—Dean A. Reichard

[57] ABSTRACT

An adjustable tissue box (20) for accommodation of tissues (26) significantly larger in quantity, in comparison with an average tissue box, while all tissues (26) are allowed to be successively dispensed, comprising: a series of ascending steps (22) and a tissue tray (24). The ascending steps (22) are formed by way of series of triangular holes (23) punched to the two opposites walls of the box (20) and bent to elongated V-shapes. The tissue tray (24) that is preferably made of cardboard, is placed under the tissues (26), to advance the tissues toward the opening (28) of the box (20) as required. The bouncing capacity of the walls of the box (20), allows the tray (24) to fall in place without being damaged or damaging the steps (22) as it shifts from one step to the next.

2 Claims, 3 Drawing Sheets

22
22

34
22
23
23
22
22
32
28
32
34
22
23
22
23
22
32
30
36
32

ADJUSTABLE TISSUE BOX

TECHNICAL FIELD

This invention is in relation with tissue boxes, more particularly, to boxes used for accommodation of large quantities of tissues.

BACKGROUND ART

Tissue boxes are produced in variety of shapes and sizes to fit different quantities of tissues. In a typical box, tissues are either arrayed in vertical layers, or successively overlapped for being dispensed consecutively as they are consumed. In either case, there are certain limitations to their dispensability, with respect to the quantity of the tissues that can be placed in a box.

Due to such limitations, the overlapping arrangement of the tissues for perfunctory dispensing is favorable merely for limited amounts of tissues that are typically not exceeding 200 layers. In practice, even boxes of 200 overlapping tissues frequently fail to dispense the last few remaining tissues. Consequently, such limitation precludes a larger quantity of tissues to be placed in a box.

DISCLOSURE OF INVENTION

Accordingly, the applicant claims the following as the principal object and advantage of the invention: The principal object is to provide an adjustable tissue box to accommodate large quantities of tissues extensively beyond their overlapping limitation for dispensability. A box that permits advancement of the tissues toward the opening surface of the box, as often as required or as the overlapping limitation of the tissues for dispensability is reached.

A significant characteristic that makes the present invention commercially desirable, is its low cost of production, in comparison with typical boxes required to accommodate the same amount of tissue. For example, an adjustable box of the present invention for accommodation of 600 tissues, costs considerably less than three typical boxes of 200 tissues. Such advantage, allows extensively larger tissue boxes produced for substantial savings, boxes that can give new meaning to the term "family size boxes."

DESCRIPTION OF THE PREFERRED EMBODIMENTS

Figure 1:
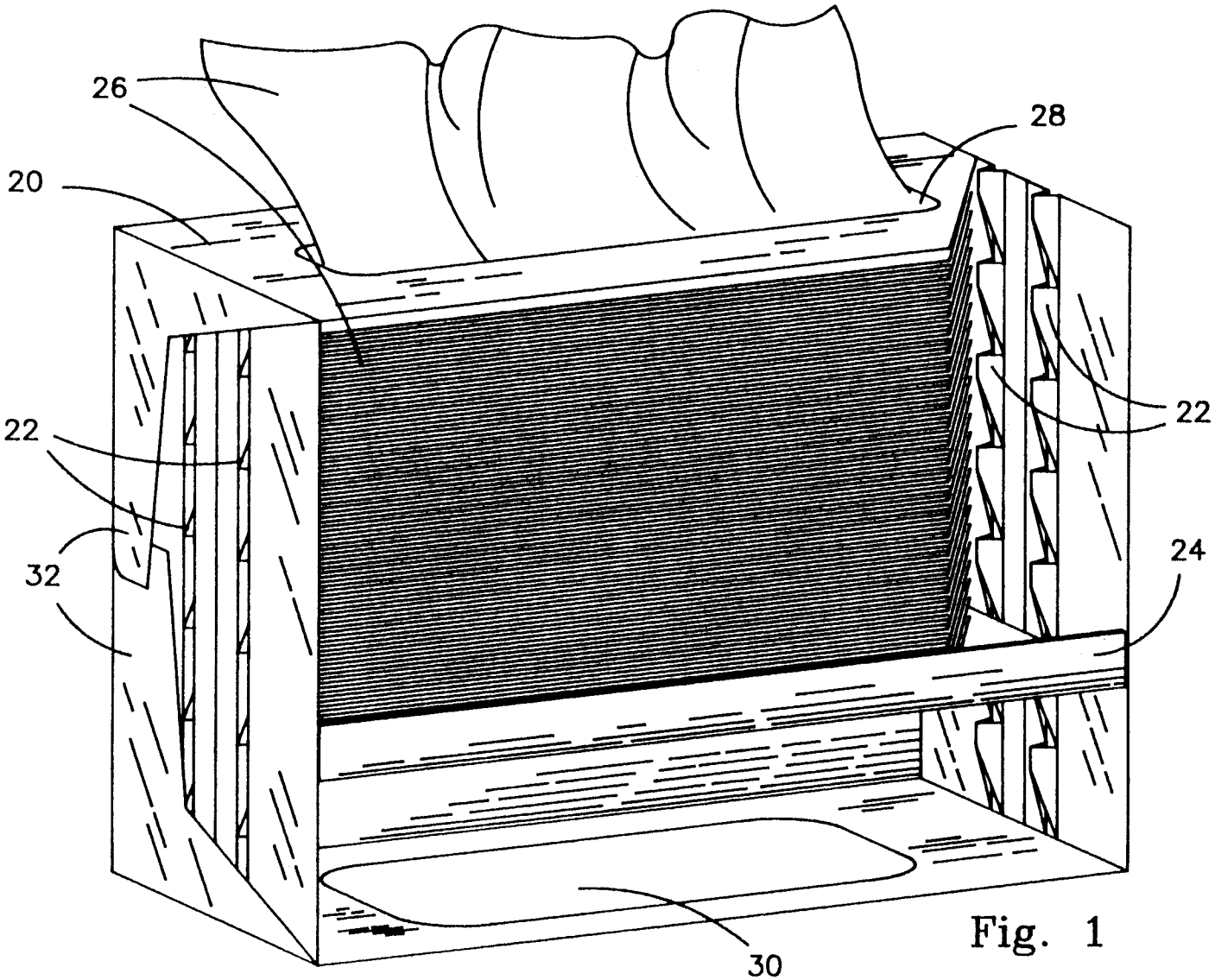
FIG. 1 is a perspective fragmentary plan view of a tissue box including ascending steps that holds a tray.

As shown in FIG. 1, a preferred embodiment of an adjustable tissue box 20 of the present invention includes a top surface, a bottom surface, four walls, and a tray 24. The top surface is having an opening 28 of proper size and shape, for the tissues 26 to be dispensed or picked. The bottom surface is also having an opening 30 of proper size and shape, which allows entering the box to advance the tray 24 and consequently the tissues 26, closer to the top surface of the box 20.

Figures 4A, 4B, 4C:
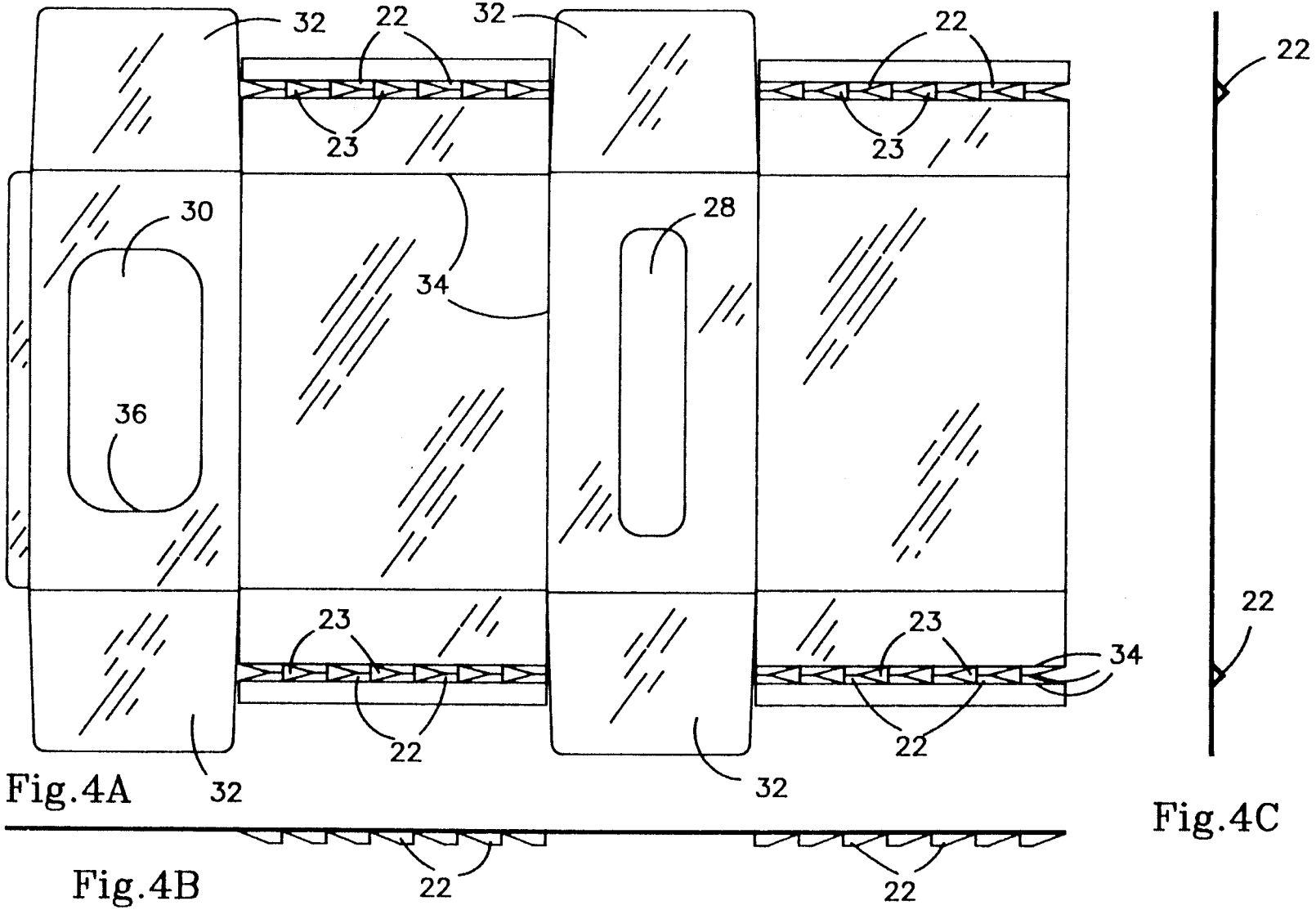
FIGS. 4A, 4B, and 4C show the top, the front and the side views, respectively, of a tissue box including the impression marks.

As shown in FIG. 4, to hold the tray 24 in place at a desirable level, multiple holes 23 of triangular shape are punched, preferably closer to the middle of the opposite walls of the box. One tip of each triangular hole 23, is facing the top surface of the box 20, where the opening 28 is placed. In this example, at least three impression marks 34 are required to allow the cardboard bend to an elongated V-shape that forms the ascending steps 22. The vertical distance between the holes 23 indicates the distance between the steps 22.

To save the integrity of the tissues 26 and prevent them from collecting dust, along with the opening 28, the opening 30 at the bottom of the box 20, is preferably including perforation marks 36 for a neat trim when the tissues 26 are to be advanced to a higher position.

As shown in FIG. 1 the overlapping panels 32 are to cover the triangular holes 23 for protection of the tissues 26 against dust, assist the stability of the elongated steps 22, and improve the appearance of the box 22.

Figure 2:
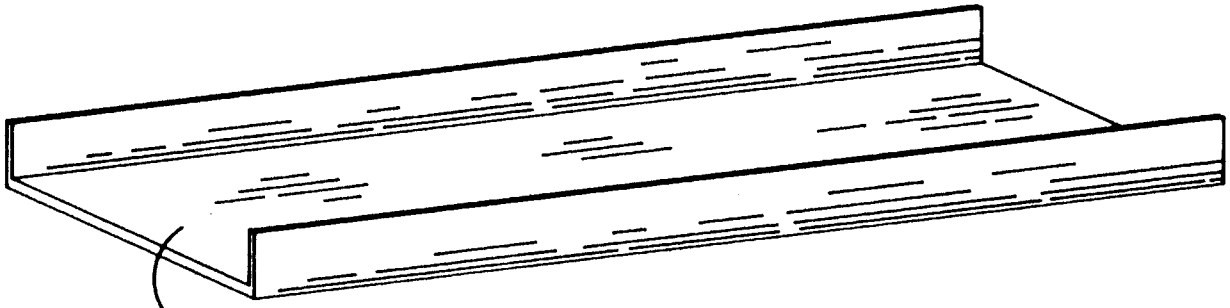
FIG. 2 is a tray for lifting and holding the tissues in place.

As shown in FIG. 2, an adequately sized and preferably formed to an elongated U-shape tray 24, is required under the tissues 26 to hold them in place as they are advanced toward the top of the box 20. The walls of the tray 24, merely serve the purpose of strengthening the tray 24 and prevent it from deformation while holding the tissues 26. Said tray 24 is preferably made of cardboard for its economical advantages.

Figure 3:
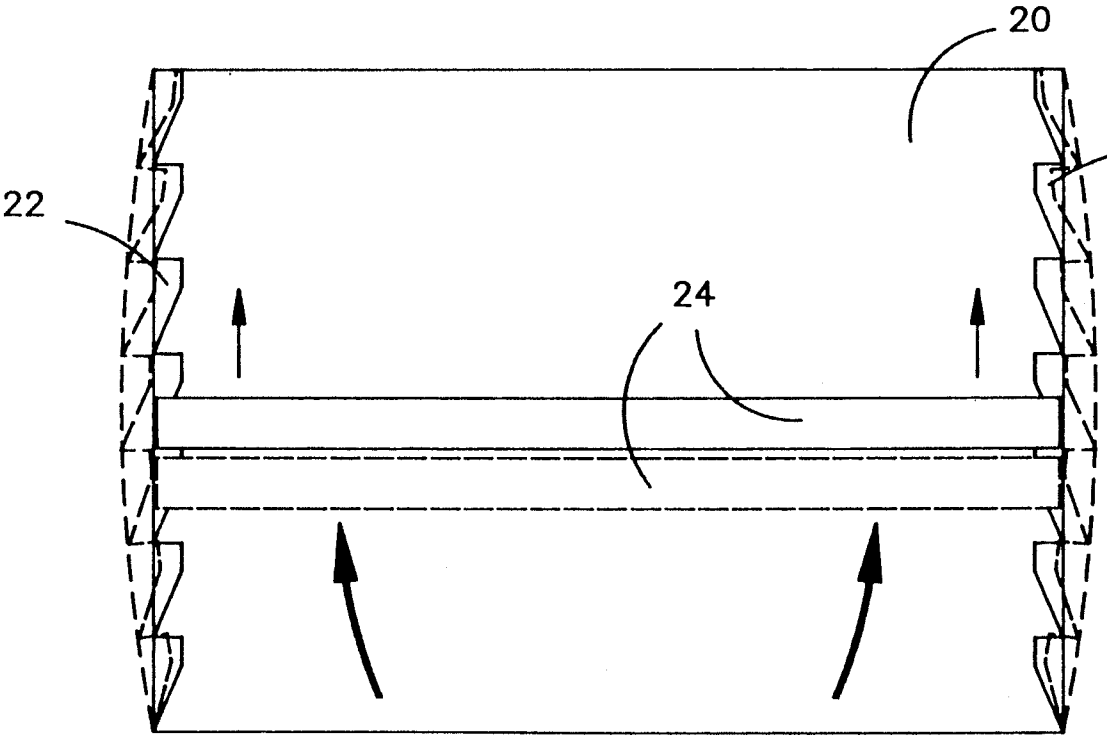
FIG. 3 illustrates bouncing of the walls of the box that causes the tray to fall in place as it advanced to the top of the box.

As shown in FIG. 3, due to a slight bouncing capacity at the mid portions of the walls where the ascending steps 22 are located, every step 22 falls in place automatically, without being damaged or damaging the tray 24 as the tray 24 is advanced toward the top surface of the box 20.

While the above description contains many specifications, the user should not construe these as limitation on the scope of the invention, but merely as an example of the preferred embodiment thereof. Those skilled in art and engineering design will envision many other possible variations within its scope. Accordingly the reader is required to determine the scope of the invention by the appended claims and their legal equivalents, not by the given examples. For instance, tissues are not necessarily to be successively overlapped or dispensed and they may either be disposable or reusable. Furthermore any other product that may share some similarity with tissues or comes in layers, may also choose to adopt the technique introduced by the present invention.

I claim:

1. An adjustable tissue box comprising:

(a) a top wall of sufficient size and strength having an opening formed therein for picking up tissues therethrough;

(b) a bottom wall of sufficient size and strength having an opening formed therein for recharging and manually advancing the tissues toward said top wall;

(c) adequate side walls of sufficient size and strength joined by said top and said bottom walls with at least two of said side walls of opposite preferable sides each having at least one opening formed therein, each said opening having positioned therein a step which extends into an interior of said tissue box for holding the tissues in place as the tissues are advanced toward the top wall of the box; and (d) a tray of sufficient size and strength placed beneath the tissues and resting on a pair of said steps to support the tissues as said tray is driven from said bottom wall toward said top wall to rest on progressively higher pairs of said steps to advance the tissues toward the top wall of the box.

2. The adjustable tissue box of claim 1 wherein said side walls of opposite preferable sides each have said at least one opening of triangular shape formed to an elongated V-Shape step.

* * * * *